US009596947B2

(12) United States Patent
Lee

(10) Patent No.: US 9,596,947 B2
(45) Date of Patent: Mar. 21, 2017

(54) HIP SEAT CARRIER SET

(71) Applicant: I-ANGEL CO., LTD, Gyeonggi-do (KR)

(72) Inventor: Jin-Seop Lee, Ansan-si (KR)

(73) Assignee: I-ANGEL CO., LTD., Gyeonggi-Do (KR)

( * ) Notice: Subject to any disclaimer, the term of this patent is extended or adjusted under 35 U.S.C. 154(b) by 66 days.

(21) Appl. No.: 14/426,587

(22) PCT Filed: Jul. 25, 2014

(86) PCT No.: PCT/KR2014/006810

§ 371 (c)(1),
(2) Date: Mar. 6, 2015

(87) PCT Pub. No.: WO2015/080363

PCT Pub. Date: Jun. 4, 2015

(65) Prior Publication Data

US 2016/0255968 A1 Sep. 8, 2016

(30) Foreign Application Priority Data

Nov. 27, 2013 (KR) ..... 20-2013-0009776 U

(51) Int. Cl.
*A47D 13/02* (2006.01)

(52) U.S. Cl.
CPC ..... *A47D 13/025* (2013.01)

(58) Field of Classification Search
CPC ..... A47D 13/025
(Continued)

(56) References Cited

U.S. PATENT DOCUMENTS 5,205,450 A * 4/1993 Derosier ..... A47D 13/025 224/161
5,224,637 A * 7/1993 Colombo ..... A47D 13/025 224/158

(Continued)

FOREIGN PATENT DOCUMENTS

CN 204617687 U * 9/2015 ..... A47D 13/025
KR 20-0459539 4/2012

(Continued)

OTHER PUBLICATIONS

Australian Office Action dated Nov. 20, 2015 issued in corresponding Australian Patent Application No. 2014321175, pp. 1-6.

*Primary Examiner* — Justin Larson
(74) *Attorney, Agent, or Firm* — Saliwanchik, Lloyd & Eisenschenk

(57) ABSTRACT

A hip seat carrier set for use in holding an infant, comprising a carrier including a first supporting member capable of supporting an infant, and a shoulder band to be attached to the user's shoulders when the user puts on the carrier; hip seat separably coupled to the carrier, including a waist belt to be fastened around the user's waist, and for holding hips of the infant thereon; and a carrier blanket separably coupled to the carrier, and including a second supporting member capable of supporting the body of the infant, and a pelvis belt to be connected to a lower portion of the second supporting member and to be put on around the user's body to support the hips of the infant, wherein the hip seat or the carrier blanket is coupled to the carrier depending on a mode of usage, can be provided.

10 Claims, 5 Drawing Sheets

(58) Field of Classification Search
USPC ..... 224/158–161
See application file for complete search history.

(56) References Cited

U.S. PATENT DOCUMENTS 5,292,042 A * 3/1994 Yamaguchi ..... A45F 3/02 224/158
5,492,256 A * 2/1996 Ive ..... A47D 13/025 220/528
5,522,528 A * 6/1996 Petricola ..... A47D 13/025 224/160
5,641,101 A * 6/1997 Nakayama ..... A47D 13/025 224/159
5,657,912 A * 8/1997 Nakayama ..... A45F 3/00 190/903
5,678,739 A 10/1997 Darling et al.
5,685,466 A * 11/1997 Hsieh ..... A47D 13/025 224/159
5,711,466 A * 1/1998 Kataoka ..... A47D 13/025 224/159
5,732,861 A * 3/1998 Jakobson ..... A44B 11/2549 224/158
5,934,528 A * 8/1999 Higuchi ..... A47D 13/025 224/159
6,186,381 B1 * 2/2001 Kernkamp ..... A47D 13/025 224/159
6,325,259 B1 * 12/2001 Tharalson ..... A47D 13/025 224/159
6,789,710 B1 * 9/2004 Szatkowski ..... A47D 13/025 224/159
7,037,155 B2 * 5/2006 Freeman ..... B63C 9/135 441/106
7,255,620 B1 * 8/2007 Shepherd ..... A47D 13/025 224/160
7,575,136 B2 * 8/2009 Kernkamp ..... A45F 3/14 224/158
7,614,533 B2 * 11/2009 Boal ..... A47D 13/025 224/159
7,686,195 B2 * 3/2010 Bangert ..... A47D 13/025 224/159
9,314,112 B2 * 4/2016 Chuah ..... A47D 13/025
2006/0261104 A1 11/2006 Zambrzycki
2007/0235479 A1 * 10/2007 Bangert ..... A47D 13/025 224/159
2008/0047987 A1 * 2/2008 Price ..... A47D 13/025 224/159
2009/0308900 A1 * 12/2009 Kernkamp ..... A45F 3/14 224/158
2011/0290831 A1 12/2011 Wang
2014/0231472 A1 * 8/2014 Cha ..... A47D 13/025 224/160
2014/0284361 A1 * 9/2014 Wang ..... A47D 13/025 224/159
2015/0157139 A1 * 6/2015 Gillam ..... A47D 9/00 224/158
2016/0106228 A1 * 4/2016 Wang ..... A47D 13/025 224/159

FOREIGN PATENT DOCUMENTS

KR 20-0459659 4/2012
KR 20-0459848 4/2012
KR 20-2013-0003372 6/2013
KR 20-0467950 7/2013
KR 101521766 B1 * 5/2015 ..... A47D 13/025

* cited by examiner

HIP SEAT CARRIER SET

CROSS REFERENCE TO A RELATED APPLICATION

This application is a National Stage Application of International Application Number PCT/KR2014/006810, filed Jul. 25, 2014; which claims priority to Korean Patent Application No. 20-2013-0009776, filed Nov. 27, 2013; both of which are incorporated herein by reference in their entirety.

TECHNICAL FIELD

The present disclosure relates to a hip seat carrier set; and, more particularly, to a hip seat carrier set enabling to hold an infant in user's chest or on user's back comfortably, and capable of changing a mode of usage depending on circumstances.

BACKGROUND ART

In general, a carrier blanket is designed to allow a user to walk while carrying an infant of an age before the first birthday, usually, an age of about 100 days after birth or thereabout, in their chest or on their back, thus allowing the user to go out with their baby comfortably and safely.

When using a conventional general carrier blanket, most of the weight of an infant would be delivered to the user's shoulders through a shoulder band. Further, depending on the posture of the user who holds the infant in their chest or on their back, the user may have to lean forward or backward to keep balanced, which may cause a strain on user's spine. Besides, the conventional carrier blanket is also problematic in that it is uncomfortable to wear.

To solve these problems of the conventional carrier blanket, there has been proposed a carrier called "hip seat" designed to deliver the weight of the infant to the user's waist or pelvis while allowing the user to hold the infant or putting down the infant easily. In general, such a hip seat includes a seat with a support therein, for allowing the infant to sit on; and a waist band having a fastening member and connected to both ends of the seat. A user wears this hip seat on their waist by using the waist band. When using such a conventional hip seat, however, the user should have their one arm put around the infant's back or abdomen (belly) for the sake of infant's safety. Thus, the user may not use their both arms freely. Especially, when used outside, if the infant falls asleep on the hip seat, the user has to hold the infant on the hip seat more carefully, so that their movements are restricted. To solve these problems, there has been proposed a product combining a carrier blanket and a hip seat in such a way that the hip seat is fastened to a bottom end of the carrier blanket.

DISCLOSURE

Technical Problem

As the infant grows up, however, the infant will gain weight. If the user carries the infant weighing much with such a product combining the carrier blanket and the hip seat, an excessively great load would be applied to user's shoulders, causing strain or pain on the shoulders.

Further, depending on circumstances such as user's physical strength, preferred posture, infant's physique, purpose of use, environment for use, and so forth, a mode of usage such as the posture of the baby and/or the state in which the user puts on the product need to be appropriately changed. Since, however, the conventional product only provides a single mode, it has been difficult for the user to use the product appropriately depending on the circumstances.

Technical Solution

In view of the foregoing problems, the present disclosure provides a hip seat carrier set designed not to apply an excessive load on users' shoulders even when an infant grows up and gains weight.

Further, the present disclosure also provides a hip seat carrier set capable of altering a mode of usage depending on circumstances such as user's physical strength, preferred posture, infant's physique, purpose of use, environment for use, and so forth.

However, the problems sought to be solved by the present disclosure are not limited to the above description and other problems can be clearly understood by those skilled in the art from the following description.

Advantageous Effects

According to exemplary embodiments of the present disclosure, since it is possible to selectively connect a hip seat or a carrier blanket to a carrier depending on an infant's weight, application of an excessive load on user's shoulders may be suppressed.

Further, since the hip seat or the carrier blanket can be attached to or detached from the carrier selectively, it may be possible to alter the mode of usage depending on circumstances such as user's physical strength, preferred posture, infant's physique, purpose of use, environment for use, and so forth.

Moreover, since it is possible to change the infant's posture depending on the circumstances, both the user and the infant may feel comfortable when the user holds the baby in their chest or on their back.

MODE FOR INVENTION

The advantages and features of the present disclosure and the ways to achieve them will become apparent from the following description of exemplary embodiments given in conjunction with the accompanying drawings. The exemplary embodiments will be described in detail so that inventive concept may be readily implemented by those skilled in the art. However, it is to be noted that the exemplary embodiments are not intended to be anyway limiting and various modifications may be made without departing from the technical concept of the present disclosure. The scope of the inventive concept will be defined by the following claims rather than by the detailed description of the exemplary embodiments.

In the following description, when there is a concern that detailed description of functions or configuration known in the pertinent art may hamper clear understanding of the inventive concept of the present disclosure, the detailed description thereof will be omitted. Further, the terms used in this document are defined in consideration of their functions in the exemplary embodiments of the present disclosure, and their definitions may be differed depending on intentions of users or operators or practices. Thus, the definitions of the terms used in this specification should be understood based on the entire disclosure of this document.

Figure 1:
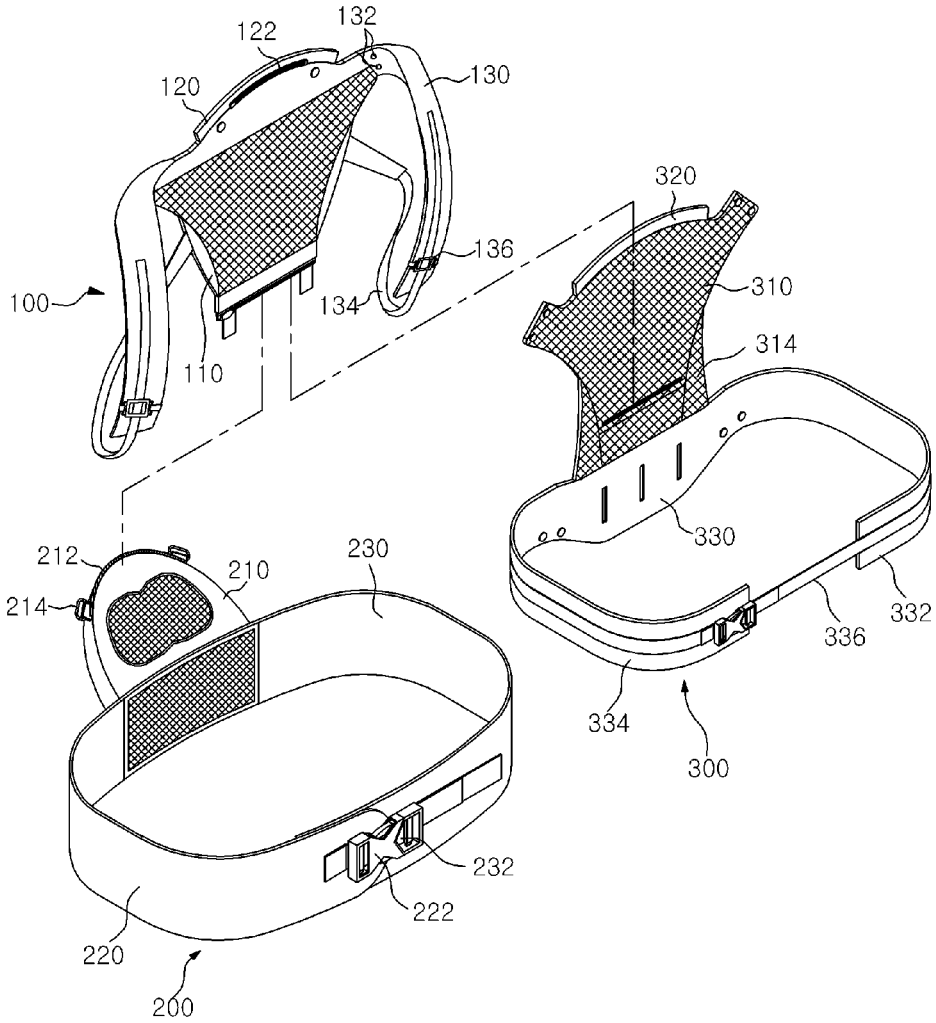
FIG. 1 is a diagram illustrating constituent components of a hip seat carrier set in accordance with an exemplary embodiment of the present disclosure.

FIG. 1 is a diagram illustrating constituent components of a hip seat carrier set in accordance with an exemplary embodiment of the present disclosure.

Referring to FIG. 1, the hip seat carrier set in accordance with the exemplary embodiment includes a carrier 100 for supporting an infant's body when a user holds the infant in their chest or on their back; a hip seat 200 capable of being coupled to the carrier 100 and for supporting the infant's hip; and a carrier blanket 300 capable of being coupled to the carrier 100, for wrapping the infant's body. The external surfaces of the carrier 100, the hip seat 200 and the carrier blanket 300 may be made of a soft material such a cloth lest the user and the bay should feel unconformable when using them. The carrier 100 may be selectively connected to the hip seat 200 or the carrier blanket 300. Depending on which one of the hip seat 200 or the carrier blanket 300 is connected to the carrier 100, a mode of usage may be changed.

In the following, connection between the constituent components in each mode of usage and detailed configuration thereof will be discussed.

Figure 2:
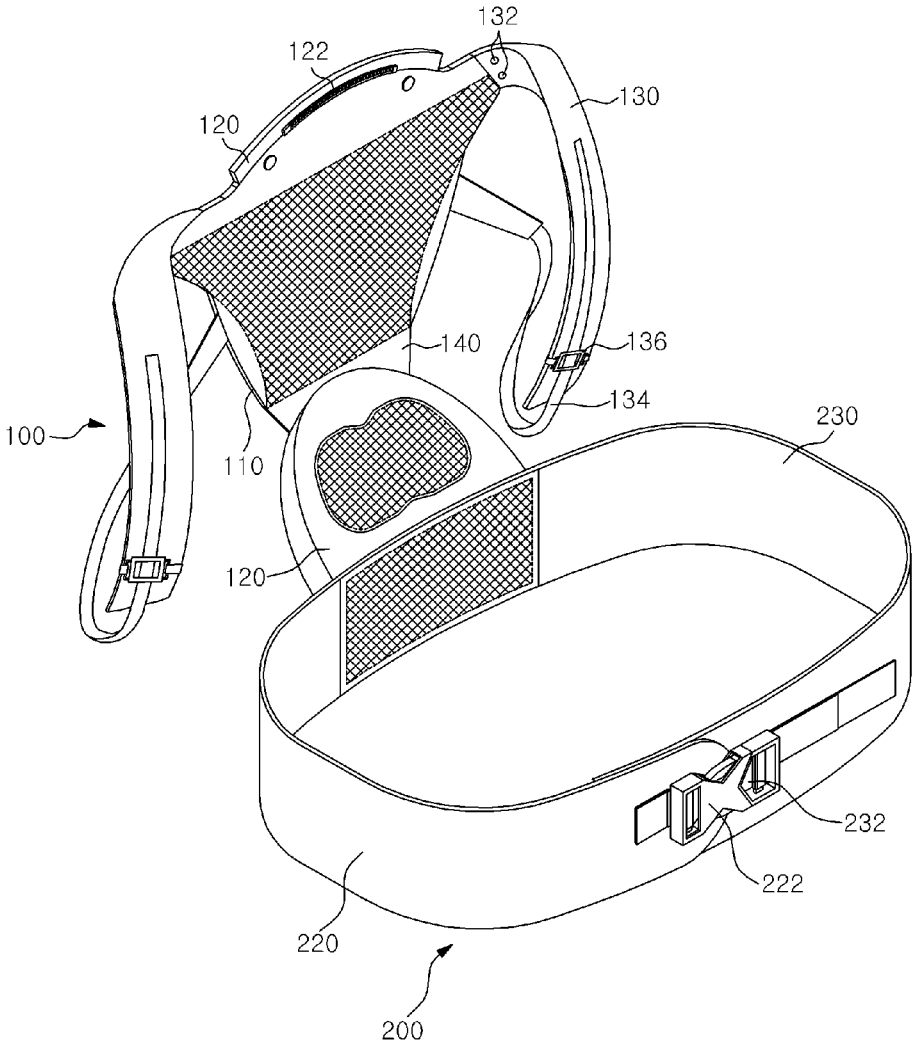
FIG. 2 is a diagram illustrating a state in which a carrier and a hip seat of FIG. 1 are connected.
Figure 3:
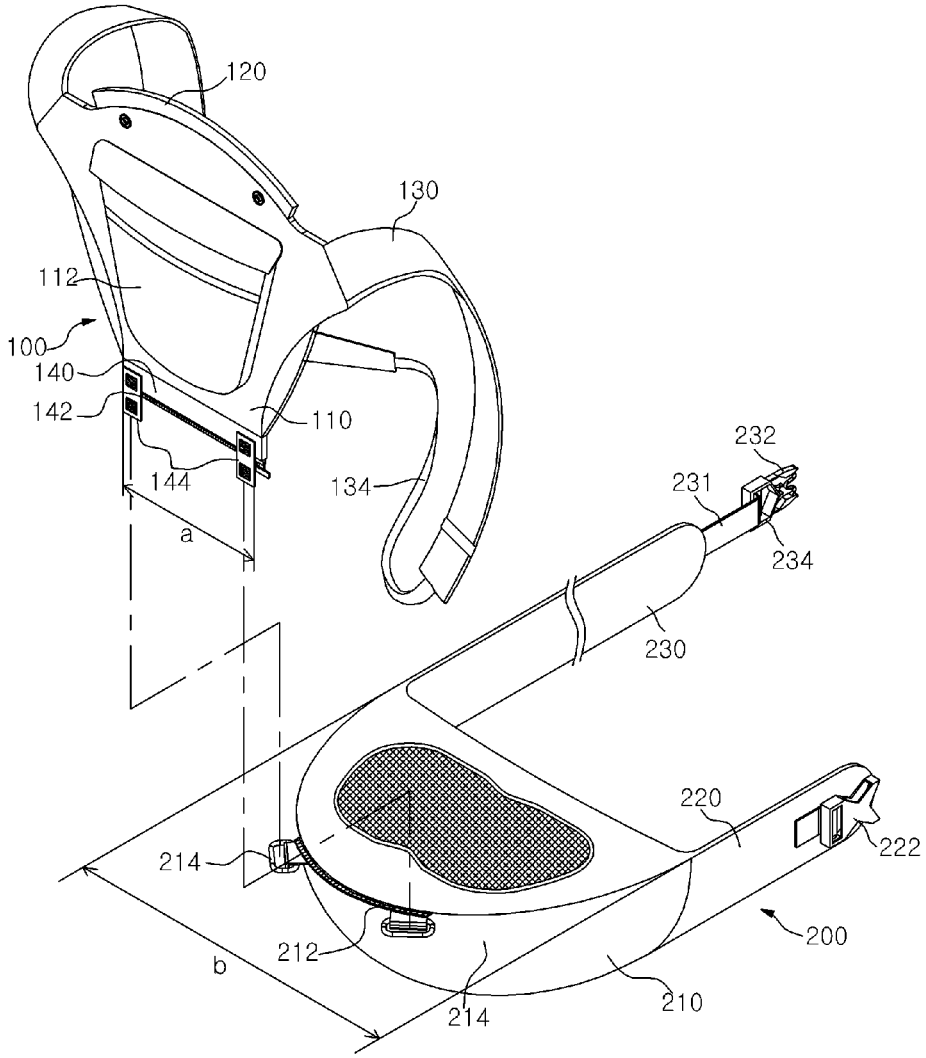
FIG. 3 is a diagram illustrating a state in which the carrier and the hip seat of FIG. 1 are separated.

FIG. 2 is a diagram illustrating a state in which the carrier and the hip seat of FIG. 1 are connected. FIG. 3 is a diagram illustrating a state in which the carrier and the hip seat of FIG. 1 are separated.

Referring to FIG. 2 and FIG. 3, the carrier 100 may include a first supporting member 110 for supporting the body of an infant; shoulder bands 130 to be attached to user's shoulders; an upper coupling part 120 to be fastened to the carrier blanket 300; and a lower coupling part 140 to be fastened to the hip seat 200 or the carrier blanket 300.

A portion of the first supporting member 110 to be brought into contact with the infant's back may be made of a soft material. The upper coupling part 120 is provided at an upper portion of the first supporting member 110. The upper coupling part 120 may include a zipper tape 122 forming a zipper section to be fastened to an upper coupling part 320 (see FIG. 5) of the carrier blanket 300. The present exemplary embodiment will be described for the case where the upper coupling part 120 and the upper coupling part 320 of the carrier blanket 320 are fastened to each other by a zipper. However, the present exemplary embodiment may not be limited thereto, and the upper coupling part 120 of the carrier 100 and the upper coupling part 320 of the carrier blanket 300 may be fastened to each other by another fastening member such as a button type mechanism.

A pocket 112 for accommodating small-sized baby products or the like may be provided at the rear surface of the first supporting member 110.

The shoulder bands 130 are connected to two opposite sides of the first supporting member 110, respectively. When fastened to the use's shoulders, the shoulder bands 130 serve to deliver the infant's weight to the user's shoulders. Further, each shoulder band 130 may be equipped with an auxiliary fastening member 132. The auxiliary fastening member 132 serve to connect the carrier 100 and the carrier blanket 300 by, for example, a button type mechanism so as not to be separated from each other on the user's shoulders when the carrier 100 and the carrier blanket 300 are coupled to each other. Further, the auxiliary fastening member 132 may be provided at positions where the shoulder band 130 is connected to the first supporting member 110.

Meanwhile, the shoulder band 130 may include a shoulder strap 134. The shoulder strap 134 allows shoulder band 130 and a part of a side portion of the first supporting member 110 to form a closed curve and to be supported on the user's shoulder. The length of the shoulder strap 134 can be adjusted by a length adjuster 136.

The lower coupling part 140 may include a zipper tape 142 forming a zipper section for allowing the carrier 100 to be fastened to the hip seat 200. The present exemplary embodiment will be described for the case where the lower coupling part 140 and the hip seat 200 are fastened to each other by a zipper. However, the present exemplary embodiment may not be limited thereto, and the lower coupling part 140 of the carrier 100 and the hip seat 200 may be fastened to each other by another fastening member such as a button type mechanism. Further, the upper coupling part 140 may include fastening straps 144 that assists the connection of the carrier 100 and the hip seat 200 when the lower coupling part 140 and the hip seat 200 are coupled. The fastening straps 144 may have Velcro thereon. When folded, the fastening straps 144 can be maintained folded by the Velcro.

The hip seat 200 includes a seat member 210 on which infant's hip is seated; and waist belts 220 and 230 extended from two opposite sides of the seat member 210. The seat member 210 may incorporate therein a (cushion) member capable of allowing the infant to feel soft and comfortable when the infant's hip is settled on the seat member 210. A zipper tape 212 to be engaged with the zipper tape 142 of the lower coupling part 140 of the carrier 100 may be provided at an upper portion of the seat member 210. Further, fastening loops 214 for allowing the fastening straps 144 of the carrier 100 to pass therethrough are also provided at the upper portion of the seat member 210.

The waist belts 220 and 230 include a right waist belt 220 extended form the right side of the seat member 210 and a left waist belt 203 extended from the left side of the seat member 210. The waist belts 220 and 230 are put on user's waist, thus allowing the hip seat 200 to be stably sustained on the user. Further, a waist strap 231 connected to the left waist belt 230 may be further provided. The waist strap 231 is used to tighten the waist belts 220 and 230 so that the waist belts 220 and 230 firmly stick to the user's waist. A buckle 232 is provided at an end of the waist strap 231, and a buckle frame 222 is provided at the right waist belt 220. As the buckle 232 is fitted into the buckle frame 222, the left waist belt 230 and the right waist belt 220 can be held together. Further, there is also provided a length adjuster capable of adjusting the length of the waist strap 231. Thus, by adjusting the length of the waist strap 231 as necessary, the waist belts 220 and 230 can be tightened to be firmly secured to the user's waist.

The present exemplary embodiment is described for the example case of connecting the waist strap 231 to the left waist belt 230. However, the exemplary embodiment may not be limited thereto. By way of example, the waist strap 231 may be provided at the right waist belt 220, or the waist strap 231 may be omitted and the left and right waist belts 230 and 220 may be stuck to each other by Velcro or the like.

As stated above, when using the carrier 100 and the hip seat 200 in combination, the user can hold the infant in a seated posture.

Meanwhile, if the user only needs to hold the infant without using the hip seat 200, the hip seat 200 may be separated from the carrier 100, and the carrier blanket 300 may be coupled to the carrier 100 instead, thus allowing the user to hold the infant comfortably.

In the following, a specific configuration in which the carrier 100 and the carrier blanket 300 are coupled will be explained with reference to FIG. 4 and FIG. 5.

Figure 4:
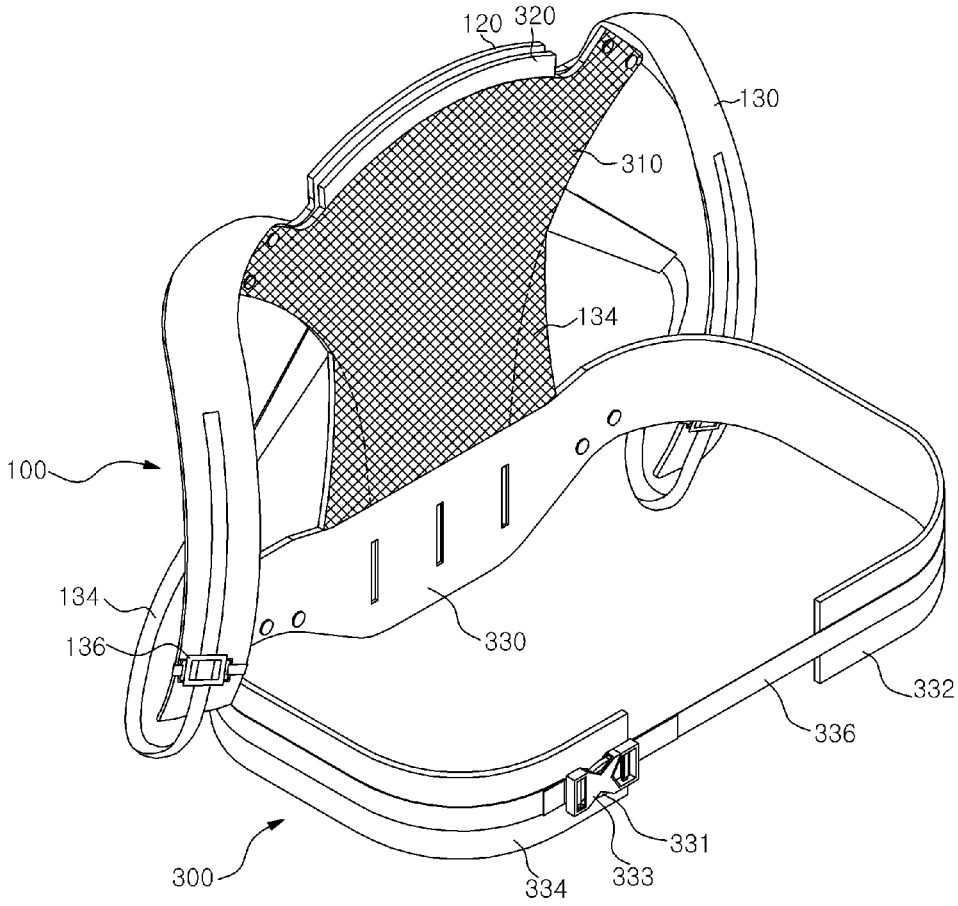
FIG. 4 is a diagram illustrating a state in which the carrier and a carrier blanket of FIG. 1 are connected.
Figure 5:
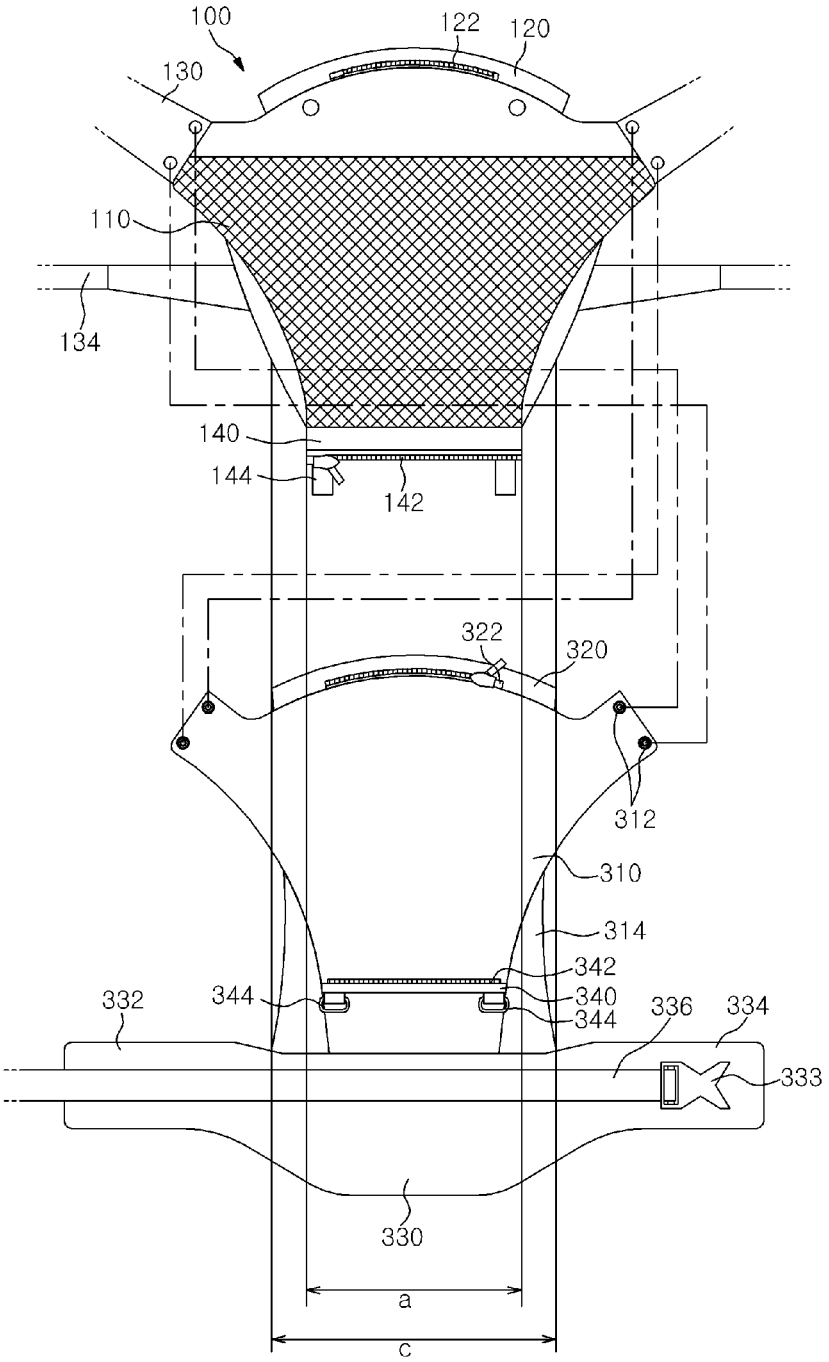
FIG. 5 is a diagram illustrating a state in which the carrier and the carrier blanket of FIG. 1 are separated.

FIG. 4 is a diagram illustrating a state in which the carrier and the carrier blanket of FIG. 1 are coupled, and FIG. 5 is a diagram illustrating a state in which the carrier and the carrier blanket of FIG. 1 are separated.

Referring to FIG. 4 and FIG. 5, the carrier 100 can be fastened to the carrier blanket 300, thus allowing the user to hold the infant comfortable and conveniently.

To elaborate, the carrier blanket 300 includes a second supporting member 310 for supporting the body of the infant when connected to the carrier 100; the upper coupling part 320 to be fastened to the upper coupling part 120 of the carrier 100; and a pelvis belt 330 to be connected to a lower side of the second supporting member 310 and put around the user's body. Further, a lower coupling part 340 to be fastened to the lower coupling part 140 of the carrier 100 may be provided at one surface of the second supporting member 310, and an auxiliary fastening member 312 to be connected with the auxiliary fastening member 132 of the carrier 100 may be further provided. The upper coupling part 320, the lower coupling part 340 and the auxiliary fastening member 312 of the carrier blanket 300 may be provided at positions corresponding to the upper coupling part 120, the lower coupling part 140 and the auxiliary fastening member 132 of the carrier 100, respectively.

A wing portion 314 extended from both sides of the second supporting member 310 may be provided at a lower portion of the second supporting member 310. The wing portion 314 may be formed to be positioned between the infant's two legs when the infant is held by the user. The wing portion 314 makes the infant's two legs to be spread by a certain width.

The upper coupling part 320 of the carrier blanket 300 may have a zipper tape 322 to be engaged with the zipper tape 122 of the upper coupling part 120 of the carrier 100. Further, the upper coupling part 320 may also be equipped with a slider for closing or opening the zipper. Here, however, the slider may be provided on the side of the carrier 100. Further, the lower coupling part 340 of the carrier blanket 300 may also have a zipper tape 342 to be engaged with the zipper tape 142 of the lower coupling part 140 of the carrier 100.

The present exemplary embodiment is described for the example case of coupling the carrier 100 and the carrier blanket 300 by means of the zippers provided at the upper and lower coupling parts thereof. However, the present exemplary embodiment may not be limited, but the carrier 100 and the carrier blanket 300 may be fastened to each other by using another general fastening member such as a button type mechanism.

The lower coupling part 340 of the carrier blanket 300 may further include fastening loops 344 for allowing the fastening straps 144 of the carrier 100 to pass therethrough. Further, an auxiliary fastening member 312 may be further provided on the side of the carrier blanket 300 where the lower coupling part 340 is provided.

As stated above, the carrier 100 and the carrier blanket 300 can be coupled to each other by the upper and lower coupling parts of the carrier 100 and the carrier blanket 300. Accordingly, the carrier 100 and the carrier blanket 300 can be attached to or detached from each other easily, and when combined together, they can be firmly fastened to each other.

Meanwhile, the pelvis belt 300 includes a left pelvis belt 332 extended to the left and a right pelvis belt 334 extended to the right. The pelvis belt 330 may be equipped with a pelvis strap 336 for bringing the left pelvis belt 332 and the right pelvis belt 334 on user's pelvis or waist to be pulled close to each other when the user holds the infant on the back.

A buckle 331 may be provided at the left pelvis belt 332, and a buckle frame 333 may be provided at the right pelvis belt 334. After the user wears the carrier 100 and the carrier blanket 300, by connecting the buckle 331 and the buckle frame 333, the user can hold the infant stably.

Hereinafter, an operation and an effect of the hip seat carrier set having the above-described configuration will be described with reference to FIG. 1 to FIG. 5.

The hip seat carrier set in accordance with the exemplary embodiment includes, as illustrated in FIG. 1, the three components: the carrier 100, the hip seat 200 and the carrier blanket 300. According to necessity, the carrier 100 may be coupled to the hip seat 200 or to the carrier blanket 300.

First, in case of using the carrier 100 and the hip seat 200 in combination, the two components can be connected by using a zipper. Specifically, by dragging the slider after securing the zipper tape 142 of the lower coupling part 140 of the carrier 100 to the zipper tape 212 of the hip seat 200, the carrier 100 and the hip seat 200 can be coupled to each other. After connecting the lower coupling part 140 of the carrier 100 and the hip seat 200 by using the zipper, the fastening straps 144 of the carrier 100 may be inserted into the fastening loops 214 of the hip seat. Then, by folding the fastening straps 144 and attaching them using Velcro, the fastening loops 214 and the fastening straps 144 can be held together. In this way, by using the zipper and the fastening straps 144, the carrier 100 and the hip seat 200 can be easily coupled to each other and used in combination.

The present exemplary embodiment is described for the case of coupling the carrier 100 and the hip seat 200 by suing the zipper. However, the exemplary embodiment may not be limited thereto, and any fastening mechanism may be used as long as the user is capable of coupling the carrier and the hip seat easily with that fastening mechanism.

After the carrier 100 and the hip seat 200 are combined, the user may put on the shoulder bands 130 of the carrier 100. Then, the user may connect the left waist belt 230 and the right waist belt 220 around the user's waist by fastening the buckle 232 and the buckle frame 222 of the hip seat 200 together and tightens the waist belts 220 and 230 around the user's waist.

In this state, by seating the infant on the seat member 210 of the hip seat 200, the user can hold the infant comfortably. Further, by adjusting the length of the waist strap 231 appropriately while holding the infant, the user may be capable of holding the infant stably. At this time, the infant may be held with their chest in firm contact with the first supporting member 110 of the carrier 100.

Referring back to FIG. 3, when the infant is seated on the hip seat 200, the infant's legs may be spread due to a width b of the hip seat 200. Here, the width b of the hip seat 200 may be defined as the largest width of the seat member 210. Further, a lower width a of the first supporting member 110 may be defined as a width of a lower end portion where the lower coupling part 110 of the carrier 100 is provided. The lower width a of the first supporting member 110 may be set to be smaller than the width b of the hip seat 200. With this configuration, the two legs of the infant are made to fall sideways to both sides of the carrier 100, so that the infant can be held comfortably.

If the user holds the infant by combining the hip seat 200 and the carrier 100, the weight of the infant may be concentrated to the seat member 210 of the hip seat 200, and the load concentrated to the seat member 210 may be dispersed to the shoulder bands 130 and the waist belts 220 and 230, so that the infant's weight may be dispersed to the user's shoulders and waist. Therefore, the user is capable of holding the infant in their chest or on the back easily without suffering a strain on their body.

If, however, the weight of the infant increases as the infant grows up, an excessively great load may be applied to the user's shoulders though the user uses the hip seat 200. If the infant weighs much, by using the carrier 100 and the carrier blanket 300 in combination, the load form the weight of the infant can be suppressed from being concentrated to the user's shoulders.

To elaborate, in case of using the carrier 100 and the carrier blanket 300 in combination, the upper coupling part 120 of the carrier 100 and the upper coupling part 320 of the carrier blanket 300 are coupled to each other. At this time, the zipper tape 122 of the upper coupling part 120 of the carrier 100 and the zipper tape 322 of the upper coupling part 320 of the carrier blanket 300 are engaged with each other, whereby the upper coupling part 120 of the carrier 100 and the upper coupling part 320 of the carrier blanket 300 are coupled to each other.

Likewise, the lower coupling part 140 of the carrier 100 and the lower coupling part 340 of the carrier blanket 300 can also be coupled to each other by means of the zipper. In this way, the carrier 100 and the carrier blanket 300 can be connected to each other at their upper and lower sides. Besides, the fastening straps 144 of the lower coupling part 140 of the carrier 100 may be inserted through the fastening loops 344 of the lower coupling part 340 of the carrier blanket 300. Then, by folding the fastening straps 144 and attaching them using Velcro, the fastening loops 344 and the fastening straps 144 can be held together. In this way, by using the zipper and the fastening straps 144, the carrier 100 and the carrier blanket 300 can be easily coupled to each other and used in combination.

Further, by fastening the auxiliary fastening member 132 of the carrier 100 and the auxiliary fastening member 312 of the carrier blanket 300 together, the carrier 100 and the carrier blanket 300 can be connected from their lateral sides as well as their upper and lower sides. Accordingly, the carrier 100 and the carrier block 300 can be used while strongly and stably combined with each other like a single unit.

The way to hold the infant by using the carrier 100 and the carrier blanket 300 combined as stated above will be briefly explained. After the user puts on the shoulder bands 130 of the carrier 130, the user then may put on the pelvis belt 330 of the carrier blanket 300 around their pelvis or waist and connect the left pelvis belt 332 and the right pelvis belt 334 together by fastening the buckle frame 333 and the buckle 332 to each other.

After wearing the carrier 100 and the carrier blanket 300 on their body in this way, the user may locate the infant in a space between the second supporting member 310 of the carrier blanket 300 and the user's chest and locate the infant's hips at a central portion of the second supporting member 310. In this way, the user can hold the infant comfortably. At this time, the posture of the infant may be set such that the chest of the infant corresponds to the upper portion of the second supporting member 310, and the legs of the infant may be spread due to the presence of the wing portions 314.

Here, referring to FIG. 5, a lower width c of the wing portion 314 of the carrier blanket 300 may be formed to be larger than the lower width a of the carrier 100. Further, the lower width c of the wing portion 314 may also be set to be larger than the width b of the hip seat 200. By setting the lower width c of the wing portion 314 of the carrier blanket 300 to be larger than the width b of the hip seat 200, the legs of the infant may be spread more widely when holding the infant with the carrier blanket 300 than in case of holding the infant with the hip seat 200.

As stated above, in case that the infant weighs much and the user feeds excessive strain on their shoulders when using the hip seat 200, the carrier blanket 300, instead of the hip seat 200, may be used in combination with the carrier 100. In this case, since the legs of the infant are spread more widely than in case of using the hip seat 200, the load from the weight of the infant may be dispersed more uniformly, as compare to the case of using the hip seat 200. Therefore, by using the carrier blanket 300 instead of the hip seat 200 when the infant weighs much, a strain on the user's shoulders can be reduced.

As discussed above, in accordance with the exemplary embodiment, since the hip seat carrier set can be used while changing the way or the mode of using it depending on circumstances, the user is capable of holding the infant in the chest or on the back conveniently depending on the circumstances.

Although exemplary embodiments of the present disclosure are described above with reference to the accompanying drawings, those skilled in the art will understand that the present disclosure may be implemented in various ways without changing the necessary features or the spirit of the present disclosure. Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

The invention claimed is:

1. A hip seat carrier set for use in holding an infant, comprising:

a carrier including a first supporting member capable of supporting the body of an infant when a user holds the infant, and a shoulder band to be attached to the user's shoulders when the user puts on the carrier;

hip seat separably coupled to the carrier, including a waist belt to be fastened around the user's waist, and for holding hips of the infant thereon; and a carrier blanket separably coupled to the carrier, and including a second supporting member capable of supporting the body of the infant, and a pelvis belt to be connected to a lower portion of the second supporting member and to be put on around the user's body to support the hips of the infant, wherein the hip seat or the carrier blanket is coupled to the carrier depending on a mode of usage.

2. The hip seat carrier set of claim 1, wherein when the carrier and the carrier blanket are separably coupled to each other, the second supporting member is overlapped with the first supporting member.

3. The hip seat carrier set of claim 1, wherein the carrier blanket further includes a wing portion having a lower width larger than a lower width of the first supporting member and a width of the hip seat to allow the infant's legs to be spread.

4. The hip seat carrier set of claim 1, wherein the carrier includes: an upper coupling part to be coupled to the carrier blanket; and a lower coupling part to be coupled to the hip seat or the carrier blanket.

5. The hip seat carrier set of claim 4, wherein the upper coupling part is coupled to the carrier blanket by a zipper, and the lower coupling part is coupled to the carrier blanket or the hip seat by a zipper.

6. The hip seat carrier set of claim 4, wherein the carrier further includes an auxiliary fastening member to be fastened to the carrier blanket.

7. The hip seat carrier set of claim 6, wherein the auxiliary fastening member is composed of a button.

8. The hip seat carrier set of claim 4, wherein the lower coupling part further includes: a fastening strap for connecting the carrier to the hip seat or the carrier blanket, and each of the hip seat and the carrier blanket includes, at a position corresponding to the fastening strap, a fastening loop to which the fastening strap is connected by being inserted thereinto.

9. The hip seat carrier set of claim 8, wherein the fastening strap is equipped with Velcro.

10. The hip seat carrier set of claim 1, wherein the hip seat further includes a seat member for allowing the hips of the infant to be settled thereon, and the waist belt extended from two opposite sides of the seat member.

* * * * *